US007690878B2

(12) United States Patent
Aaron

(10) Patent No.: US 7,690,878 B2
(45) Date of Patent: Apr. 6, 2010

(54) RAIL CAR HAVING EXTENDABLE RAMP BEING MOVABLE BY A LOAD BEARING DRIVE SYSTEM

(75) Inventor: Charles Wayne Aaron, Hutto, TX (US)

(73) Assignee: Georgetown Rail Equipment Company, Georgetown, TX (US)

( * ) Notice: Subject to any disclaimer, the term of this patent is extended or adjusted under 35 U.S.C. 154(b) by 1007 days.

(21) Appl. No.: 11/345,800

(22) Filed: Feb. 2, 2006

(65) Prior Publication Data

US 2007/0176453 A1 Aug. 2, 2007

(51) Int. Cl.
*B60P 3/06* (2006.01)

(52) U.S. Cl. ..... 414/537; 414/479; 414/480; 410/3; 105/355; 105/356; 104/137

(58) Field of Classification Search ..... 414/479, 414/480, 537; 105/355, 356, 458; 104/137; 410/3, 6, 7

See application file for complete search history.

(56) References Cited

U.S. PATENT DOCUMENTS

| | | | | | |
|---|---|---|---|---|---|
| 1,416,190 | A * | 5/1922 | Gass et al. | 414/574 |
| 3,155,258 | A * | 11/1964 | Fincannon | 414/498 |
| 4,179,997 | A * | 12/1979 | Kirwan | 410/53 |
| 4,470,746 | A | 9/1984 | Delachapelle | 414/470 |
| 5,066,188 | A * | 11/1991 | Bush | 414/339 |
| 5,216,956 | A * | 6/1993 | Adams, Jr. | 105/4.2 |
| 5,429,532 | A * | 7/1995 | Auclair | 439/793 |
| 5,832,555 | A * | 11/1998 | Saucier et al. | 14/71.1 |
| 6,379,100 | B2 | 4/2002 | Schultz | 414/499 |
| 6,394,734 | B1 * | 5/2002 | Landoll et al. | 414/480 |
| 6,575,516 | B2 | 6/2003 | Webber | 296/61 |
| 6,718,886 | B2 | 4/2004 | Engle | 105/355 |
| 6,763,768 | B2 | 7/2004 | Hart et al. | 105/458 |
| 6,918,734 | B2 * | 7/2005 | Nick et al. | 414/522 |
| 7,063,494 | B2 * | 6/2006 | Smith, Jr. | 414/471 |
| 2002/0094261 | A1 | 7/2002 | Fischer et al. | 414/537 |
| 2002/0172584 | A1 | 11/2002 | Huggins | 414/537 |
| 2004/0111814 | A1 | 6/2004 | Allen | 14/69.5 |

* cited by examiner

*Primary Examiner*—Michael S Lowe
(74) *Attorney, Agent, or Firm*—Howrey LLP

(57) ABSTRACT

A ramp stored under the deck of a rail car may be extended using a load-bearing drive system for the loading of freight or equipment onto the rail car. The surface of the ramp may comprise a rail portion or similar structure to allow the loading of rail bound equipment, such as rail maintenance equipment, onto the deck of the rail car.

9 Claims, 2 Drawing Sheets

RAIL CAR HAVING EXTENDABLE RAMP BEING MOVABLE BY A LOAD BEARING DRIVE SYSTEM

TECHNICAL FIELD OF THE INVENTION

This invention relates generally to a system to load equipment or freight onto rail cars in an efficient manner. Specifically, an extendable ramp is stored under the deck of a rail car. The ramp is actuated using a support and drive system. The ramps can be extended in a cantilever action, from beneath the deck, then lowered to the rail when nearly fully extended.

BACKGROUND AND OBJECTS OF THE INVENTION

The present invention is a rail car adapted for ease of loading and unloading cargo, typically equipment used to maintain railroad track. The maintenance of railroad track requires a lot of effort and equipment, which is usually rather heavy. Some of the equipment has rubber tires, such as backhoes, but most of the equipment has steel rails wheels, thus being rail bound. Additionally, rail maintenance equipment typically does not have couplers, preventing movement as part of a train. The use of rail cars is one way to transport the maintenance equipment. However, the loading and unloading of the equipment onto and off the rail car is difficult and can be problematic. Generally, the loading and unloading of rail cars is done by various methods each of which has certain disadvantages.

One such method is to use a crane to load and unload the rail car. However, the use of a crane to load and unload rail cars is expensive. Further, this method can be rather time consuming and presents a certain amount of danger if the crane equipment were to fail.

Another method is positioning rail cars next to a stationary or permanent ramp or platform. The use of a ramp is fast and relatively safe. However, because such ramps and platforms are stationary, loading and unloading of rail cars is limited to the locations of such ramps or platforms. Additionally, the permanent ramp needs to comprise a rail like structure and also be connected or aligned to the rails for the loading and unloading of rail bound equipment. This would require a substantial length of track to move equipment from the rail to the ramp.

Another method is the use of a mobile ramp. This method requires placement of the ramp prior to loading or unloading of the equipment. Additionally, such a mobile ramp must still be present at the desired location. Due to the height of the rail car decks and heavy weight of the equipment being transported, such portable ramps must be a considerable length, thus requiring significant effort to transport the ramp. The length of portable ramps also requires considerable storage space to keep the ramp when not in use. As with the permanent ramp, the mobile ramp needs to comprise rail structures and be connected to or aligned with the rails for the loading and unloading of rail bound equipment.

Yet another method used to load cargo onto rail cars is the use of a ramp car such as disclosed in U.S. Pat. No. 6,718,886. The disclosed rail car has a ramp hingedly connected to the rail car and when not in use the ramp is rotated to a vertical position. However, in an effort to reduce the size of the ramp, the deck of the rail cars are often lowered causing clearance and coupling problems. Further, the ramp disclosed in U.S. Pat. No. 6,718,886 does not allow for the loading of rail bound equipment.

SUMMARY OF THE INVENTION

In accordance with the present disclosure, the above disclosed disadvantages and other disadvantages are overcome by the disclosed ramp car system, where as a support and drive system extends and retracts a ramp from under the deck of the rail car.

In a preferred embodiment of the invention, a rail car includes a deck with a ramp stored under its deck adjacent to one end. The ramp may include a top and bottom surface and is extendable from the end of the rail car to substantially ground level. The bottom surface of the ramp may include a drive system to extend or retract the ramp. Preferably the design of the ramp drive system allows the drive system to support a substantial load perpendicular to the ramp while still providing linear movement to the ramp. In such an embodiment, the drive system would support the ramp in cantilever until it reached the ground level.

In one embodiment, a rail car includes a straight ramp stored under its deck that may be extended from underneath of the deck. In an alternative embodiment, the ramp may be curved to allow for the ramp to contact ground level with a decreased longitudinal length. In one embodiment the top surface of the ramp may include a portion of rail or similar structure that allows the loading of rail bound equipment. Additionally, the rail or similar structure may align with a similar structure located on the top of the rail car deck. Further, a bridge may connect adjacent rail cars and the bridge may comprise rails or similar structures aligned with corresponding rails located on adjacent cars.

The ramp may include a roller that travels along a guide attached to the rail car. The guide positions one end of the ramp in a desired location while extending or retracting the ramp. The rail car may include means for rotating the ramp drive system to extend or retract the ramp. The means for rotating the ramp drive system may be a hydraulic motor. Other means for rotating the ramp drive system to extend or retract the ramp may include an electric motor, a pneumatic motor, or a manual crank for example.

The rail car may include a second ramp located adjacent to one end of the rail car and stored under the deck. The ramp is extendable from the end of the deck to substantially ground level. In some embodiments the second ramp is substantially straight. Alternatively, the second ramp may be curved. Another embodiment may include a portion of rail or similar structure on the top surface of the second ramp to facilitate the loading and unloading of rail bound equipment.

In one embodiment, a method of loading a rail car comprises, providing a rail car having retractable ramps located under its deck, rotating a weight bearing drive system to extend the ramps to ground level, and moving an object up the ramps unto the deck of the rail car. The method of loading the rail car could further include moving the object to the opposite end of the deck of the rail car and across a bridge, to the deck of an adjacent rail car.

These and other objects and advantages of the present invention will be made apparent from the following detailed description, with reference to the accompanying drawings. In the drawings, the same reference numbers are used to denote similar components in the various embodiments.

BRIEF DESCRIPTION OF THE DRAWING

The following figures form part of the present specification and are included to further demonstrate certain aspects of the present invention. The invention may be better understood by reference to one or more of these figures in combination with the detailed description of specific embodiments presented herein.

Figure 1A:
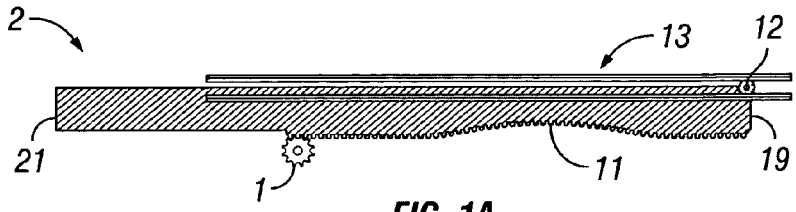
FIGS. 1A-1D depicts the various motions of a ramp 2 with a roller 12 and a guide 13 of the present disclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

DESCRIPTION OF ILLUSTRATIVE EMBODIMENTS

Illustrative embodiments of the invention are described below as they might be employed in the use of designs for a rail car with a retractable and extendable ramp stored underneath the deck. In the interest of clarity, not all features of an actual implementation are described in this specification. As used herein, sprocket may be utilized interchangeably with pinion and each term is to be given its ordinary meaning. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Further aspects and advantages of the various embodiments of the invention will become apparent from consideration of the following description and drawings.

Figure 1B:
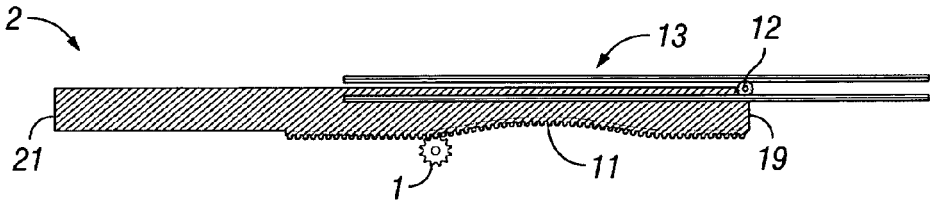
Figure 1C:
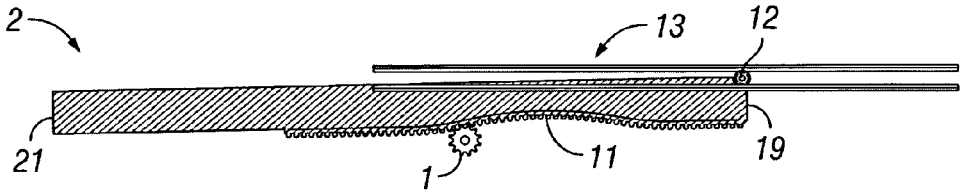
Figure 1D:
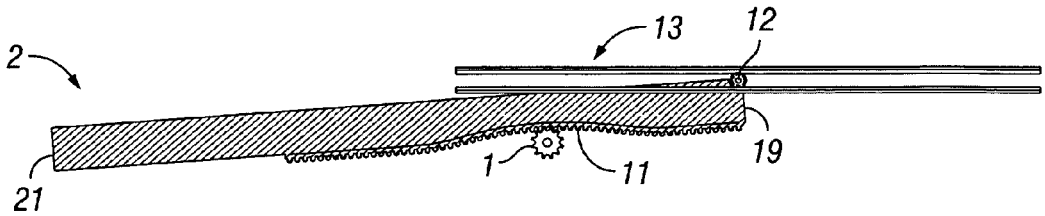

FIGS. 1A-1D depict the motion of a ramp 2 and sprocket 1 as the ramp 2 is extended. FIG. 1A shows the ramp 2 in a substantially retracted position, for example beneath the surface of a rail car. The ramp 2 may include a pin or roller 12 and a guide 13. As the ramp 2 is extended or retracted the roller 12 may travel along the guide 13 keeping the end 19 of the ramp 2 properly aligned as the other end 21 extends out from the deck of a rail car. As depicted in FIGS. 1A-1C the end 21 of ramp 2 may extend horizontally from the deck as it begins to move. In one embodiment, the ramp 2 may include a curved portion 11 that causes the end 21 of ramp 2 to descend downwards when the sprocket 1 has rotated such that it is located at the curved portion 11 of ramp 2. As depicted in FIG. 1D, the end 21 of the ramp 2 extends down towards ground level as the sprocket 1 rotates through the curved portion 11 of the ramp 2.

Figure 2A:
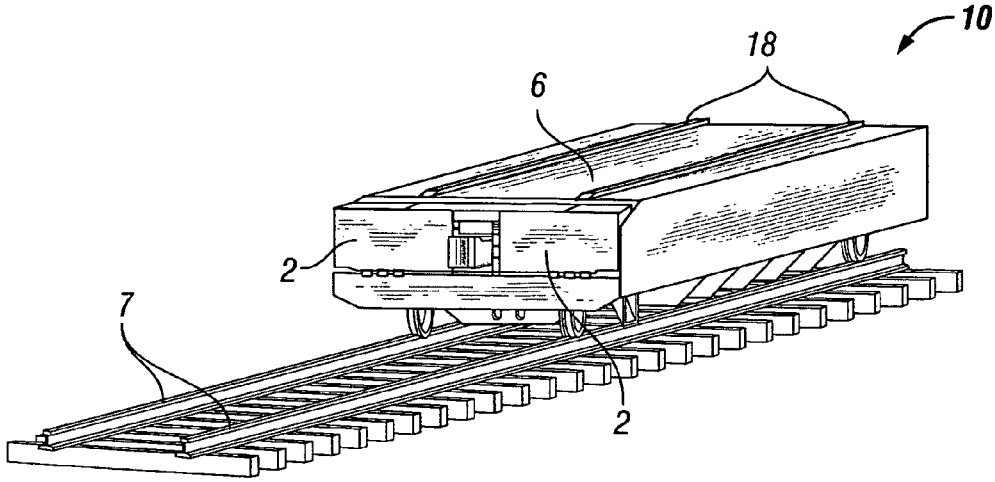
FIG. 2A is a perspective view of a rail car 10 of the present disclosure wherein ramps 5 are retracted and stored underneath the deck 6 of the rail car 10.
Figure 2B:
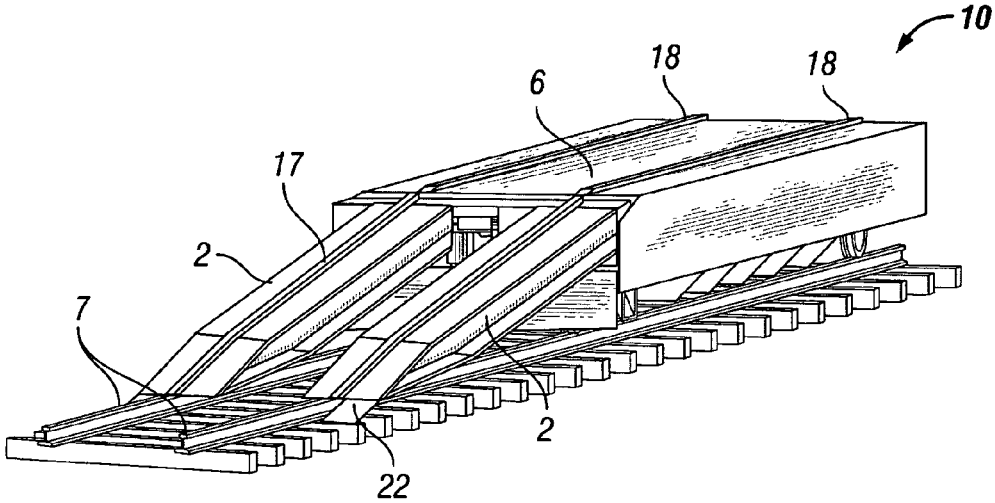
FIG. 2B is a perspective view of a rail car 10 of the present disclosure wherein ramps 5 are extended and contact rails 7 and/or the ground.

FIG. 2A depicts a rail car 10 having ramps 2 retracted underneath the deck 6 of the rail car 10. FIG. 2B depicts a rail car 10 wherein the ramps 2 are extended from beneath the deck 6 and contact the rail 7 and/or ground. The ramps 2 may include a portion 22 that contacts that ground alongside rails 7 enabling equipment or vehicles having rubber wheels to travel up the ramps 2. Each ramp 2 may include a portion of rail 17 or similar structure that would enable rail bound equipment (not pictured) to travel up the ramps 2. The deck 6 of the rail car 10 may include two portions of rail 18 or similar structures in alignment with the rails 17 on the ramps 2 enabling rail bound equipment to be loaded onto the deck 6 of the rail car 10.

The rail car 10 contains means for rotating (not pictured) the sprocket 1 to retract or extend the ramps 2. The preferred means for rotating the sprocket 1 is a hydraulic motor due to the minimal space required for a hydraulic motor compared to other available rotating means. However, other means for rotating the sprocket may be utilized as would be realized by one of ordinary skill in the art having the benefit of this disclosed such as an electric motor, pneumatic motor, or manual crank, for example.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A rail car comprising:

a deck having a first end and a second end;

a ramp located within the deck adjacent the first end of the deck, the ramp being configured to extend from the first end of the deck to substantially ground level, thereby resting on a top of railroad track rails; and a load bearing drive system configured to extend or retract the ramp, wherein the ramp comprises a portion which extends beyond the top of the railroad track rails to contact a crosstie for receiving a wheel of a vehicle.

2. The rail car of claim 1, wherein the drive system is able to support a load perpendicular to the ramp as the ramp is extended or retracted.

3. The rail car of claim 1, wherein the ramp further comprises a portion of a rail adapted for receiving a wheel of a rail vehicle.

4. The rail car of claim 3, wherein the rail car further comprises a portion of a rail mounted on the deck and substantially aligned with the portion of rail on the ramp.

5. The rail car of claim 1, wherein the ramp further comprises a roller and a guide, the roller to travel along the guide to position the ramp during extending or retracting the ramp.

6. The rail car of claim 1, wherein the rail car further comprises means for rotating the load bearing drive system.

7. The rail car of claim 6, wherein the means for rotating the load bearing drive system is a hydraulic motor.

8. The rail car of claim 1, wherein the rail car further comprises a power unit for rotating the load bearing drive system.

9. The rail car of claim 8, wherein the power unit for rotating the load bearing drive system is a motor.

* * * * *